United States Patent [19]

Manning

[11] 4,295,694

[45] Oct. 20, 1981

[54] INTERCEPTOR PLUG

[76] Inventor: Robert E. Manning, 310 Siesta Ave., Thousand Oaks, Calif. 91360

[21] Appl. No.: 50,709

[22] Filed: Jun. 21, 1979

[51] Int. Cl.[3] ..... H01R 15/00

[52] U.S. Cl. ..... 339/8 P; 339/182 RS; 339/183

[58] Field of Search ..... 339/182 RS, 183, 176 R, 339/8 R, 8 P; 200/6 B, 153 LB

[56] References Cited

U.S. PATENT DOCUMENTS

| | | | |
|---|---|---|---|
| 1,251,618 | 1/1918 | Bahls et al. | 339/182 RS |
| 1,834,184 | 12/1931 | Schramm | 339/183 |
| 2,530,415 | 11/1950 | Wilson | 339/183 |
| 3,419,684 | 12/1968 | Lord et al. | 200/6 B |
| 3,826,986 | 7/1974 | Brown et al. | 339/8 |
| 4,037,319 | 7/1977 | Maloof | 339/183 |
| 4,110,696 | 8/1978 | Meeks | 339/183 |

*Primary Examiner*—John McQuade

[57] ABSTRACT

An electrical plug is described that mates with existing standard electrical jacks to intercept the electrical signal making it available for controlling the off/on condition or volume of the output transducer of the electrical device or for monitoring or measuring the signal without interruption of the operation of the device.

1 Claim, 2 Drawing Figures

Fig. 1.
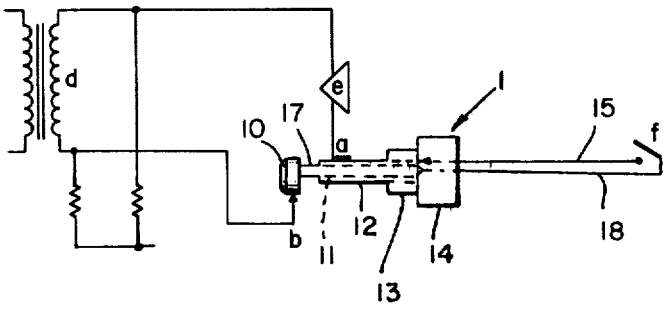
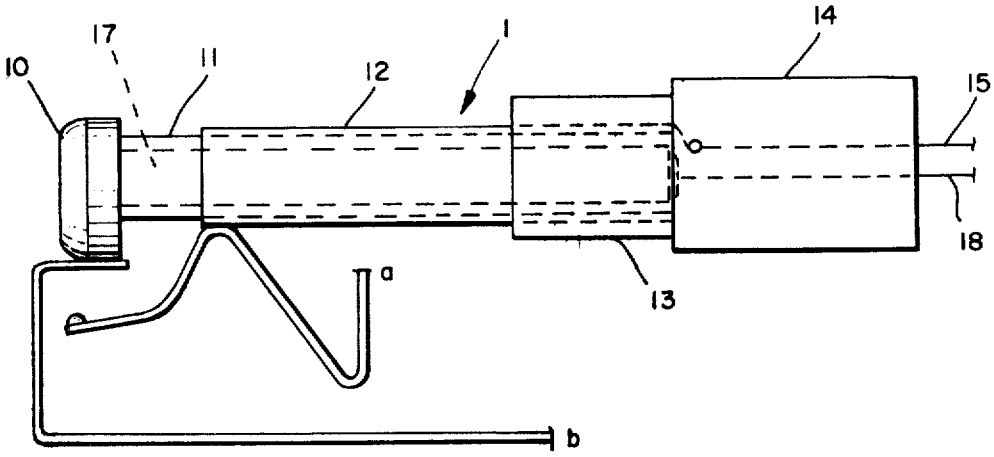
Fig. 2.

INTERCEPTOR PLUG

BACKGROUND OF THE INVENTION

A number of methods have been devised for remote control of television sets. Most of these methods require complex and expensive circuit additions to the television and a complex remote control assembly. A simple and inexpensive remote control for the on/off condition of the loudspeaker is a length of wire and a switch. Such simple assemblies have been widely marketed. The drawback to these otherwise inexpensive remote controls is that the average householder must hire a television repairman to make the installation. The installation charge of $25 to $50 is more than most people are willing to pay.

Many television sets are equipped with a jack in the audio output circuit that permits use of a headset while disabling the loudspeaker. The present invention concerns itself with an interceptor plug that provides access to the audio signal via the existing jack and routes the signal through a control exterior to the television set, then back to the original path to the loudspeaker. As a result, the householder can make his own installation of the inexpensive wire and switch remote control merely by inserting the interceptor plug into the existing jack.

SUMMARY OF THE INVENTION

The object of this invention is to provide a remote control for audio systems associated with radios and televisions sets at an affordable cost and minimum hardware complexity. It enables the homeowner to install a remote control merely by inserting an Interceptor Plug into an existing jack on his television or radio set.

The invention is a new plug that mates with conventional phone jacks in such a way as to intercept the signal, route the signal to an external control device and return the signal to the path of the signal prior to insertion of the plug. This routing contrasts with that provided by the standard plug that receives the signal and disconnects the internal transducer, then presents the signal to an external transducer (usually a headset or a loudspeaker) which is provided a ground at the system chassis through the standard plug and jack combination.

The new plug performs in this manner because of the eccentric tip that makes contact with the fixed contact of the phone jack and because of the insulation of the positioning sleeve that prevents grounding of the signal to the chassis of the television or radio set. Compared to the circuit established by the conventional plug and jack, a usefully different circuit is established by the Interceptor Plug and the jack.

BRIEF DESCRIPTION OF THE DRAWINGS

FIG. 1 illustrates schematically the use of the Interceptor Plug to intercept the signal from the audio output stage of a signal receiver, route the signal to an external control device (in the drawing, a switch) and return the signal to its original path.

FIG. 2 illustrates a construction of the interceptor plug and the manner in which the interceptor plug interfaces with the standard jack.

DESCRIPTION OF THE INVENTION

This invention provides a means to control an electrical signal from a point remote from the system generating the signal without modification of the system. The invention is an electrical plug that mates with the standard electrical jack used in many electrical and electronic systems but which makes the signal intercepted available for control rather than use only to drive a remote transducer.

The conventional plug used with the conventional jack causes the system transducer to be disconnected from the signal path and the signal to be diverted to a remote transducer such as a headset or loudspeaker, following which the signal is returned to ground at the system chassis.

The new plug, inserted into the conventional jack, intercepts the signal, routes the signal to a control device such as an off/on switch with or without a volume control or, for monitoring and measurement, any display or recording device. The signal is then returned, modified or unmodified, to the original path to drive the transducer of the signal generating system. The essence of the invention, then, is a plug that allows the signal to be intercepted, operated on at a remote position and returned to its original path to operate the system transducer rather than be grounded to the system chassis after energizing a remote transducer. In effect, the new plug allows the standard jack to become a dual purpose device.

FIG. 1 illustrates a preferred embodiment of the invention. The interceptor plug 1, inserted into the standard jack (shown only as contacts a and b) intercepts the signal from the output transformder of a system at a, diverts the signal to an external control device f and returns the signal, as modified, to the original path at b. If the control device is a switch f as shown in FIG. 1, the signal is not returned to its original path when the switch is open, of course, absence of signal at the system transducer e being the desired state when the switch is open.

The invention is illustrated in detail in FIG. 2 which also shows certain parts, a and b, of the standard jack vital to an understanding of the new interceptor plug's operation. The novelty of the invention resides in the shape of the tip 10, the eccentricity of the tip 10 relative to the central shaft 17 and the use of insulation material for the positioning sleeve 13. The plug, in addition to the central shaft 17, eccentric tip 10 and positioning sleeve 13, heretofore cited, consists of an insulating sleeve 11 and an output contact sleeve 12 and a grip 14. Conductive wires 15 and 18 are attached to the output contact sleeve 12 and to the central shaft 17, respectively, completing the assembly as illustrated in FIG. 2.

The use of the invention can be understood by further reference to FIG. 2. The plug 1 is inserted into the body of the jack (not shown) while rotated approximately 180° from final operating position shown. In the rotated position, the tip 10 passes through the jack body and over the resilient spring contact of the jack. As the tip 10 approached its final position the positioning sleeve 13 becomes fully engaged with the jack body. The plug 1 is then rotated approximately 180° causing the eccentric tip 10 to bear on the jack contact, b. Also, the output contact sleeve 12 bears on the resilient spring contact a of the jack. In this final operating position, as shown in FIG. 2, the signal is intercepted by the contact of the output contact sleeve 12 with the resilient spring contact a of the jack. The signal is conducted via the wire 15 to the external control (not shown in FIG. 2) and returned via the wire 18 to the central shaft 17, thence to the eccentric tip 10 and then to the input contact of the jack, b. Note that the positioning sleeve 13, unlike its counterpart in the plug, insulates output contact sleeve 12 from the jack body.

It will be obvious to knowledgeable persons that the new plug has many applications in remote signal control, monitoring and measurement.

What is claimed is:

1. An interceptor plug for intercepting an phone signal available at a standard electrical jack comprising:

(A) a central shaft of electrically conductive material having an integral interior tip, said tip being eccentric relative to said central shaft;

(B) an electrically insulating sleeve concentric and coextensive with said central shaft except for said tip;

(C) an electrically conductive sleeve concentric and coestensive with and exterior to said insulating sleeve except that the length of said conductive sleeve is adjusted to expose said insulating sleeve at said interior tip end;

(D) a positioning sleeve of electrically insulating material surrounding the combination of said central shaft, insulating sleeve and conductive sleeve so as to insulate said conductive sleeve from the body of said jack;

(E) a grip of nonconductive material firmly affixed to said positioning sleeve, said grip surrounding two conductive wires running lengthwise through said grip and extending beyond the ends of said grip; and, (F) a connection means for connecting one of said wires to said exterior end of said central shaft and the other of said wires to said exterior end of said conductive sleeve.

* * * * *